United States Patent [19]

Lehr et al.

[11] 3,961,707

[45] June 8, 1976

[54] CATHODE RAY TUBE OR FUNNEL SHIPPING AND/OR STORAGE CONTAINER

[75] Inventors: David R. Lehr, Hoffman Estates; James H. Pollard, Westmont, both of Ill.

[73] Assignee: Zenith Radio Corporation, Chicago, Ill.

[22] Filed: Oct. 21, 1974

[21] Appl. No.: 516,328

[52] U.S. Cl. ..... 206/419; 206/386; 206/497; 206/512

[51] Int. Cl.[2] ..... B65D 19/04; B65D 21/02; B65D 65/02; B65D 85/42

[58] Field of Search ..... 206/386, 418–420, 206/422, 426, 497, 499, 509, 512, 521; 217/26.5

[56] References Cited

UNITED STATES PATENTS

| | | | |
|---|---|---|---|
| 2,774,473 | 12/1956 | Williams | 206/422 |
| 3,405,799 | 10/1968 | Weller et al. | 206/422 |
| 3,406,819 | 10/1968 | Brander | 206/422 |
| 3,799,382 | 3/1974 | Munroe | 217/26.5 X |
| 3,835,986 | 9/1974 | Le Beau | 206/497 X |
| 3,850,295 | 11/1974 | Black | 206/386 X |

FOREIGN PATENTS OR APPLICATIONS

| | | | |
|---|---|---|---|
| 6,612,761 | 9/1967 | Netherlands | 206/422 |

*Primary Examiner*—Steven E. Lipman
*Attorney, Agent, or Firm*—John H. Coult

[57] ABSTRACT

This disclosure depicts an improved shipping and/or storage container for television cathode ray tubes or funnels. The container has a base, a cap, and preferably one or more intermediate shelves. The base and the cap are separated by a plurality of rigid posts which give stacking strength to the container. The base defines a plurality of cavities configured and sized to snugly receive the faces of a plurality of face-down tubes (or funnels). Each shelf has openings configured and sized to permit the shelf to fit over the face-down tubes (or funnels) and other openings for receiving a plurality of face-up tubes (or funnels). Each shelf, when assembled, rests on the face-down tubes (or funnels) and supports the face-up tubes (or funnels) in space-conserving relationship between the face-down tubes (or funnels). The cap defines cavities configured and sized to snugly receive the faces of the face-up tubes (or funnels). The entire assembly is preferably enclosed within a shrink-wrap covering to seal the container contents from moisture and dirt. An embodiment is disclosed especially for shipping and/or storing cathode ray tube funnels which utilizes a plurality of shelves for stacking the funnels in nested relationship.

20 Claims, 5 Drawing Figures

49
51
14
40
41
48
37
30
42
34
32
46
12
35
31
39
28
29
10
18
38
26
16
20

56
68
70
72
72
66
58
60
72
52
74
62
74
64
54
66

52
56
70
58
60
62
66
54

CATHODE RAY TUBE OR FUNNEL SHIPPING AND/OR STORAGE CONTAINER

BACKGROUND OF THE INVENTION

Cathode ray tubes (CRT's) and CRT funnels, especially in the large sizes, present shipping and storage problems which are quite unique and exceptionally burdensome. Cathode ray tubes and funnels are massive, yet extremely fragile. A finished 25 inch diagonal color tube, e.g., weighs approximately 60 pounds yet has a slender, thin-walled neck which is easily cracked or broken.

Cathode ray rubes and funnels are currently shipped and stored in corrugated cardboard containers. These have been found to be extremely costly, the costs being identifiable in four categories.

1. Materials

The dry strength of corrugated cardboard is greatly deteriorated by rough handling, humid ambient conditions, and water saturation. As a result, cardboard CRT and funnel shipping containers are capable of being reused a very limited number of times. The stacking strength of conventional cardboard containers is not sufficient to permit stacking of the containers to heights which can best utilize warehouse and transport vehicle space. Collapse of stacked containers causes damage to the containers and often to their fragile contents. Conventional cardboard CRT and funnel shipping containers comprise a large number of parts, typically 16 or more, held together by steel bands. These bands often break, permitting the container to disintegrate.

2. Labor

Conventional cardboard containers require substantial labor in their assembly and disassembly, in CRT (or funnel) packing and unpacking, in container stacking and unstacking and in container part sorting for reuse. Assembly complexity frequently results in improper assembly and consequent container failures.

3. Logistics

Conventional cardboard CRT and funnel shipping and/or storage containers must be handled on skids. The skids, if left with the supported containers, consume valuable space in transport vehicles and warehouses. If the skids are removed to conserve space, the loading and unloading time and labor is greatly increased. Conventional containers are bulky to transport for reuse, and are incapable of being stacked to cost-efficient container densities in warehouses and transport vehicles.

4. CRT and Funnel Breakage

The use of conventional cardboard CRT and funnel shipping and/or storage containers results in a high rate of breakage — typically as much as 1%–2% of all goods shipped. Breakage is due primarily to the collapse, crushing and/or disintegration of the containers. Also, significant breakage is due to the fact that the CRT's and funnels are not securely held within conventional containers.

It is not unusual to see in a truck or warehouse a multi-tiered stack of cardboard CRT or funnel containers, worth thousands of dollars, toppled or otherwise damaged due to container failure, or to see cardboard CRT or funnel containers falling apart in a humid warehouse with damaged contents exposed, or disintegrating containers held together with tape.

Millions of dollars are needlessly spent by the television industry each year on conventional cardboard shipping and storage containers and on repair or replacement of broken CRT's and funnels. CRT and funnel breakage in shipment or storage is so substantial as to require special salvage facilities for salvaging reusable CRT and funnel parts.

OBJECTS OF THE INVENTION

It is an object of this invention to provide a greatly improved shipping and/or storage container for television cathode ray tubes and funnels which overcomes each of the aforementioned drawbacks of present corrugated cardboard containers; it is thus an object to provide a CRT or funnel container yielding very substantial economies in material, labor and logistics-related costs, and reduced CRT and funnel breakage.

It is another object to provide a shipping/storage container for television tubes and funnels which is very strong and durable, yet relatively lightweight and simple in construction and assembly.

It is another object to provide a shipping and/or storage container for television cathode ray tubes and funnels which can be readily adapted to accommodate tubes of different sizes and configurations.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

As will be described in detail below, the containers of the present invention represent a radical departure from conventional closed-in cardboard CRT/funnel shipping/storage containers. The present invention teaches an open-sided structure comprising multiple tiers of stiff article-holding shelves or trays, with stacking strength being given by strong corner posts or columns. The entire assembly is preferably surrounded by a shrink-wrap covering to seal the container contents from moisture and dirt. As used herein, "open-sided" means the sides are not enclosed by a structural covering, as in the case of a cardboard container, but does not exclude a covering intended, e.g., to exclude moisture and dirt.

The invention thus involves dividing the CRT/funnel container requirements into three groups: (1) those that pertain primarily to article holding and securing, (2) those that pertain primarily to stacking and handling of containers with minimum damage to container contents and at as low cost as possible, and (3) those that deal with protecting the contents from moisture and dirt. The prior art approach blurs these requirements and, as a result, has resulted in the evolution of a container which is totally inadequate to meet the needs of the television tube manufacturers.

Figure 1:
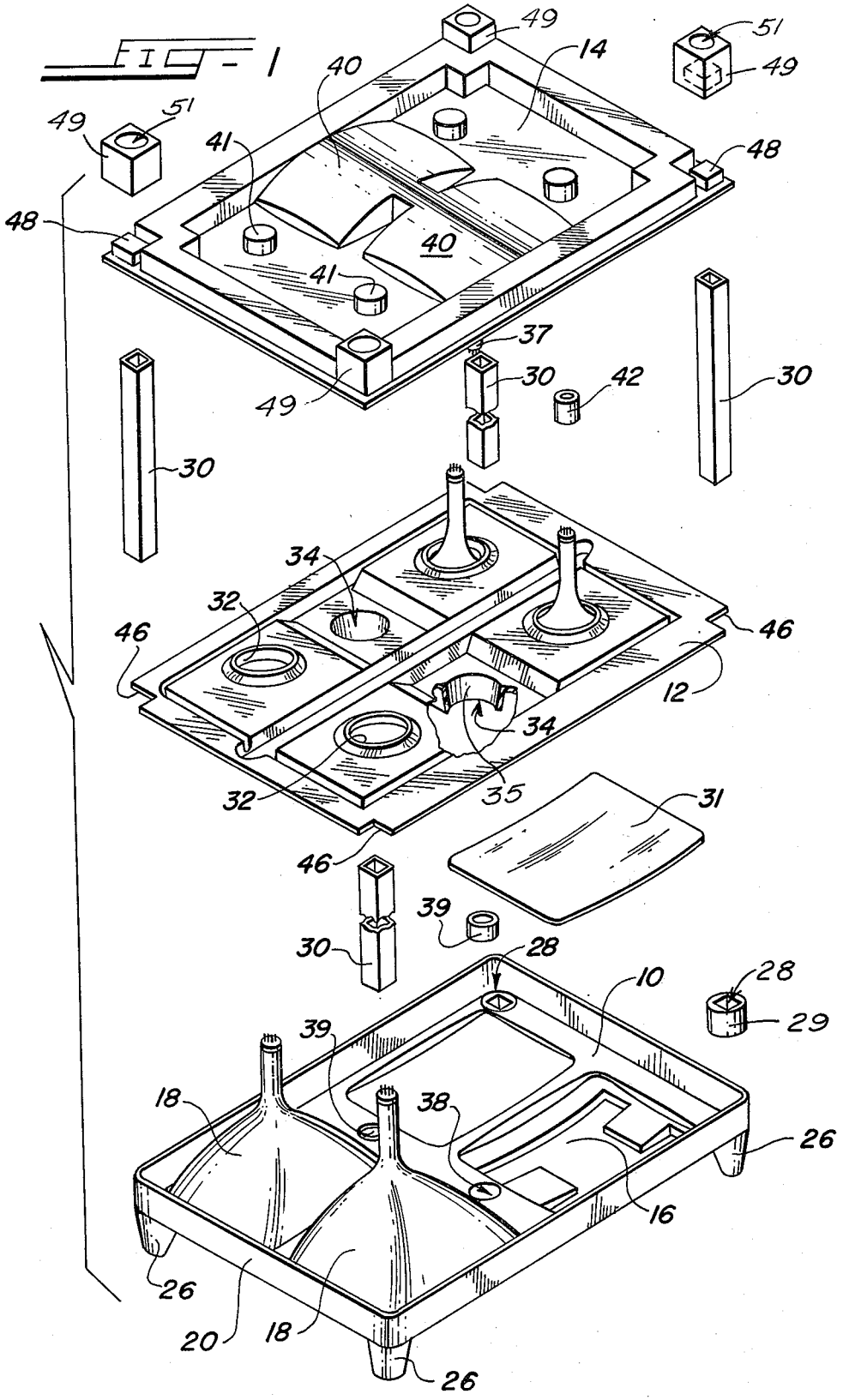
FIG. 1 is an exploded view of a shipping/storage container especially for finished television cathode ray tubes which is constructed according to the present invention.
Figure 2:
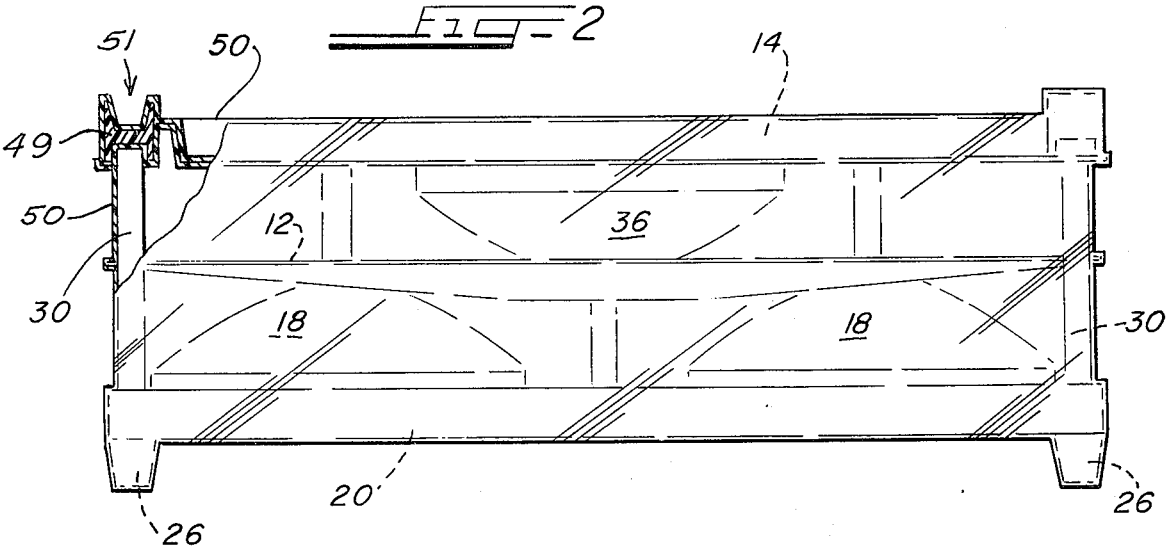
FIG. 2 is a side elevational view of the FIG. 1 container, shown fully assembled and enclosed in a shrink-wrap outer covering.

FIGS. 1–2 depict a preferred form of an improved shipping container especially for television cathode ray tubes constructed to implement the present invention. The illustrated preferred embodiment of the invention comprises three basic components for holding and securing the container contents — a base 10, a shelf 12 and a cap 14. In the FIGS. 1–2 embodiments, the base 10 is shown as taking the form of a stiff sheet-like element defining a plurality of cavities 16 (four in this embodiment) configured and sized to snugly receive the faces of face-down tubes 18. The base 10 is preferably molded as a unitary structure from structural foam (polyethylene, polypropylene or polystyrene) or formed from a single sheet of material such as SMC (sheet molding compound) fiberglass. The material for the base must be hydrophobic to repel water and to resist humid ambient conditions. The base 10 is contoured for high stiffness and is shown as including a stiffening flange 20 around the periphery thereof which serves also as a lift-truck fork guard.

The base 10 is shown as including means for accommodating the forks of a fork-lift truck, and thus eliminating the need for skids in handling the container. In this embodiment, the provision takes the form of means for elevating the container body sufficient for the passage of lift-truck forks therebeneath. The container thus serves as its own skid. In the illustrated FIGS. 1–2 embodiment, the skid-obviating means is shown as taking the form of integral legs 26 which extend below the lowermost point on the bottoms of the cavities 16 a distance sufficient to permit passage of lift-truck forks.

The legs 26 serve also to receive and hold in sockets 28 therein a plurality of posts 30 which give stacking strength to the container. The posts 30 are described in more detail below. The sockets 28 are preferably formed in molded inserts 29 which fit into the hollow legs 26.

The base 10 preferably also includes a plurality of cushioning pads 31, one in each of the cavities 16, for cushioning the faces of the face-down tubes 18. The pads may, e.g., be composed of polyethylene foam.

The shelf 12 is illustrated as comprising a rectangular sheet-like element having beveled openings 32 configured and sized to receive the funnels of the face-down tubes 18. The shelf 12, when assembled, fits over and rests upon the funnels of the face-down tubes 18. The shelf 12 has additional openings 34 between the openings 32 (here shown as two in number) configured and sized to receive the funnels of face-up tubes 36. The shelf serves to support tubes 36. The openings 34 are located between the openings 32 such that the face-up tubes 36 nestle in space-conserving relationship between the face-down tubes 18. The stiff shelf 12 and the openings 32, 34 therein assist in holding the tubes securely against rattling and maintain the pre-established spacing between the tubes at all times, even under rough handling. This is extremely important because of the fragility of the CRT necks and their high susceptibility to being broken.

When assembled, the necks 37 of the face-up tubes 36 are received snugly in neck cavities 38 in the base 10. More specifically, the necks are received in cushioning liners 39 in the cavities 38. Like the cushioning pads 31, the liners 39 may be composed of polyethylene foam. The shelf 12, like the base 10, is contoured for stiffness and is preferably formed integrally from a sheet of such material as structural foam or vac-formed ABS.

An important feature of the shelf 12 is the guide cones 35 surrounding the openings 34. These cones 35 serve, during packing of the container, to guide the neck 37 of a faceup tube 36 into the proper cavity 38 in the base 10. Shorter packing time results.

The cap 14 preferably is a rectangular sheet-like element, contoured for stiffness, which may also be molded from structural foam or formed integrally from a single sheet of SMC-type fiberglass. The cap 14 defines a plurality of cavities 40 (here shown as being two in number) configured and sized to snugly receive the faces of the face-up tubes 36. The cap 14 also includes a plurality (here four in number) of cavities 41 for receiving and securing the necks of the face-down tubes 18. These cavities 41, like the cavities 38, preferably each include a cushioning liner 42.

Like the base cavities 40 preferably each include a pad (not shown) for cushioning the faces of each of the face-up tubes 36.

The four posts 30 lend overall structural strength to the container and particularly give it stacking strength. As will become evident, the posts 30 and other stacking provsions to be described, permit the containers to be stacked post-on-post. In the preferred embodiment, one of the posts 30 is provided at each corner of the container. The posts 30 preferably fit between the base 10 and the cap 14 and serve, by means of notches 46 in the shelf 12, to index the shelf 12 to the base 10 and cap 14. The cap 14 has an integral socket 48 at each corner for receiving the upper end of one of the posts 30.

The posts 30 may be of any of a variety of suitable cross-sectional shapes, but are here shown as being tubular members of generally square cross-section. The posts are preferably also composed of fire-retardant pultruded fiberglass. Other materials such as wood or steel may be employed, but a steel post, e.g., would be more apt to result in tube breakage due to careless handling during packing or unpacking of the containers. Importantly, the length of the posts is such that the posts, and not the CRT's, bear the weight of stacked-on containers.

To facilitate stacking of the containers, at each corner of the cap 14 there is provided a molded stacking insert 49. The insert 49 has a recess in the bottom thereof into which the socket 48 is pushed and cemented. In the top of the insert 49 is a recess 51 configured to receive the bottom of a leg 26 on the base 10.

The container is quickly assembled by positioning the face-down tubes 18 on the base 10, placing the shelf 12 over the face-down tubes 18, inserting the posts 30 in the corners of the base 10, placing the face-up tubes 36 on the shelf 12 and assembling the cap 14. The final operation is to enclose the container in a shrink-wrap covering 50, which may, for example, be a polyethylene sheet. The container may be steel-banded, if necessary. The shrink-wrap covering 50 serves primarily to seal the contents of the container from moisture and dirt. One type of shrink-wrap covering is the conventional bag-type which is shrunk in a heat tunnel. Another type of shrink-wrap covering which may be employed is the type sometimes termed a "stretch-wrap". This type of covering is packaged in rolls and would be stretched around the sides of the container to seal the container contents. It requires no shrink tunnel.

Whereas it is contemplated that containers of various shape, capacity, configuration and dimension may be constructed according to the principles of this invention, the illustrated preferred embodiment preferably has the following specifications in an application for shipping 23 inch and 25 inch (diagonal) color cathode ray tubes:

| | |
|---|---|
| length | 53¾" |
| width | 37¼" |
| height | 24½" |
| stacking height | 23¼" |
| posts 30 | 1½" × 1½" × ⅛" fiberglass tubing |
| neck cavities 38, 41 | 2¼" diameter |
| liners 24, 39 | ¼" urethane foam |
| container capacity | 6 tubes |
| base, shelf and cap material | structural foam or fiberglass |
| shrink-wrap covering | Polyethylene |

Figure 3:
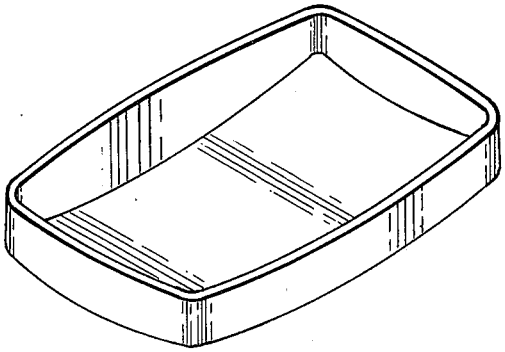
FIG. 3 is a view of an insert useful for adapting the FIGS. 1–2 container for tubes of different size and/or configuration.

The container of the present invention may be adapted to receive cathode ray tubes of various sizes and configurations by merely fitting into each of the cavities 16 and 40 an insert, such as shown in FIG. 3. The insert may be formed of structural foam and, in the illustrated embodiment, takes the shape of a collar for reducing the effective size of the cavities 16, as from 25 inches to 23 inches (diagonal tube face measurement).

Another advantage of the present invention is that the base, shelf and cap may be nested, permitting compact storage. Further, due to the relatively few number of container parts and the respective nesting capability of the base, shelf and cap, sorting labor is reduced.

Whereas it has been suggested that the base 10, shelf 12 and cap 14 be formed of structural foam or SMC-type fiberglass, many other suitable materials may be employed. These include vacuum-formed ABS, polypropylene, polyethylene, BMC (bulk molding compound) fiberglass, vacuum-formed acrylic sheet reinforced with chopped fiberglass, sprayed chopped fiberglass with gel-coated surface, steel or aluminum.

The FIGS. 1–2 container has been shown as being rectangular in overall shape, however, other configurations may be employed. Other provisions than as shown may be made for obviating the need for a skid. For example, rather than providing legs on the base, the base may be configured to define specific channels or passageways along the bottom thereof into which the lift-truck forks are to be inserted.

Whereas the base, shelf and cap preferably are formed to provide a high degree of stiffness, alternative stiffening configurations than those shown may be used. Whereas the FIGS. 1–2 embodiment shows a container for shipping six cathode ray tubes, it is contemplated that containers of other sizes and with other packing arrangements and capacities may be provided.

Whereas the illustrated preferred embodiment is a three-layered structure (base, shelf and cap), it is contemplated that multi-layered structures having two layers (no shelf) or more than three layers may also be constructed to implement the principles of this invention.

Figure 4:
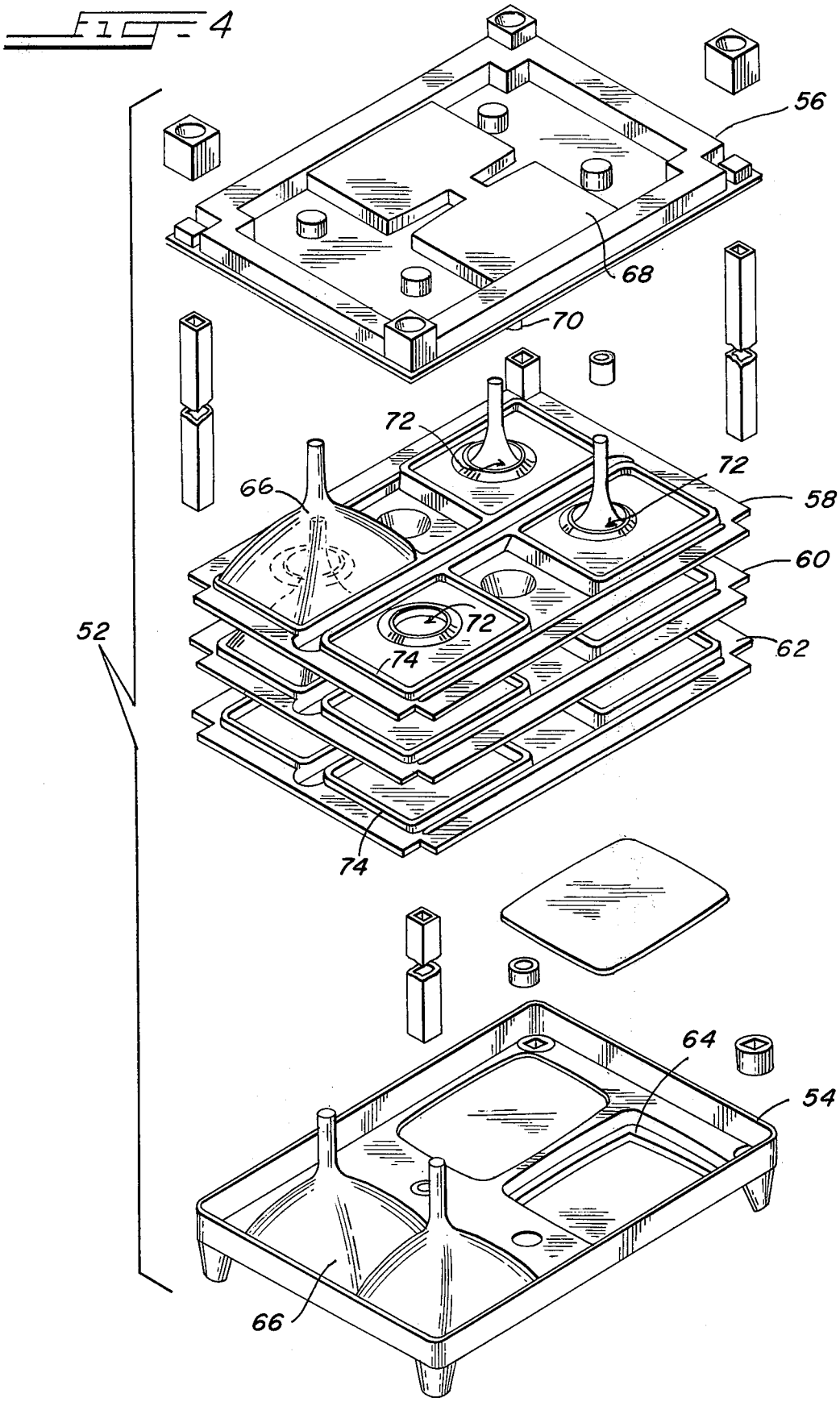
FIGS. 4 and 5 are exploded and assembled views of an embodiment of the invention especially for shipping and/or storing television CRT funnels.
Figure 5:
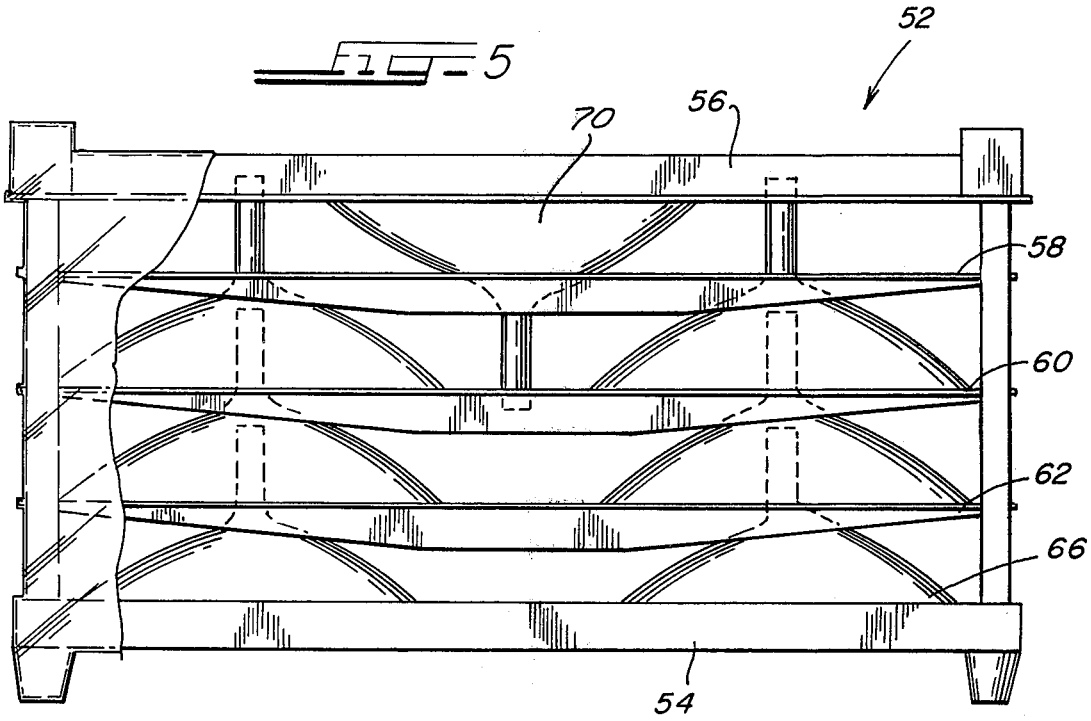

The FIGS. 1–2 embodiment may be employed, as is, for shipping and/or storing CRT funnels, however it is not the best mode contemplated for shipping/storing funnels, per se. FIGS. 4–5 show yet another embodiment of the invention especially designed for shipping or storing cathode ray tube funnels. This embodiment advantageously employs a plurality of shelves in addition to a base and a cap. The FIGS. 4 and 5 container 52 comprises a base 54, a cap 56 and three shelves 58, 60, 62. The base may be constructed very similar to the base 10 in FIGS. 1–2, with the primary difference being that the cavities 64, instead of being configured and sized to receive a faceplate, are sized and configured to receive the seal land (hereinafter the "face") of a face-down funnel 66.

The cap 56 may be constructed very similar to the cap 14 in the FIGS. 1–2 embodiment, the primary exception being that the cavities 68, rather than being configured to receive a faceplate, are configured to receive the face of a face-up funnel 70.

The FIGS. 4–5 embodiment is most distinct from the FIGS. 1–2 embodiment in its utilization of a plurality of shelves, here shown as three in number, for effecting a high packing density of face-down funnels. The shelves 58, 60, 62 may be constructed similar to the shelf 12 in the FIGS. 1–2 embodiment with the primary exception that there is provided around each of the openings 72 for receiving face-down funnels a rectangular ridge 74 configured to surround and hold against movement a face-down funnel 66 placed on the shelf.

In other respects the container 52 may be constructed as the container shown in FIGS. 1–2, with the modifications and variations suggested therefor being applicable as well to the container 52.

The invention is not limited to the particular details of construction of the embodiments depicted and other modifications and applications are contemplated. Certain changes may be made in the above-described methods and apparatus without departing from the true spirit and scope of the invention herein involved. It is intended that the subject matter in the above depiction shall be interpreted as illustrative and not in a limiting sense.

What is claimed is:

1. A durable, high-stackable, multi-tiered, hydrophobic shipping/storage container for television cathode ray tubes or funnels or other articles having a massive funnel at one end and a fragile neck at the other end, said container comprising:

a base defining a first plurality of cavities configured and sized to individually snugly receive the faces of a like first plurality of face-down tubes or funnels and also defining a second plurality of cavities configured and sized to individually snugly receive the necks of a second plurality of face-down tubes or funnels, said base having integral hollow legs spaced around the periphery of the container for elevating the container body sufficiently to pass the forks of a fork-lift truck therebeneath such that said container serves as its own skid;

a cap defining cavities configured and sized to individually snugly receive the necks of the face-down tubes or funnels; and a plurality of posts positioned between said base and cap and in said hollow legs of said base for spacing said base and cap and for giving stacking strength to the container, said container being structured to be stacked post-on-post such that said posts support substantially the entire load of any stacked-on containers.

2. The container defined by claim 1 including a shrink-wrap outer covering primarily for sealing the container contents from moisture and dirt.

3. The container defined by claim 1 wherein said container is rectangular, said base and cap are rectangular and said posts are four in number — one being provided in each corner, said base and cap having integral corner provisions for receiving and holding said posts.

4. A durable, high-stackable, multi-tiered, hydrophobic shipping/storage container for television cathode ray tubes or funnels or other articles having a massive funnel at one end and a fragile neck at the other end, said container comprising:

a base defining a plurality of cavities configured and sized to snugly receive the faces of a like plurality of face-down tubes or funnels;

at least one intermediate shelf having openings configured and sized to fit over and rest upon said face-down tubes or funnels and other openings for receiving a plurality of face-up tubes or funnels such that said tubes or funnels are supported on said shelf in space-conserving relationship between said face-down tubes or funnels;

a cap defining cavities configured and sized to snugly receive the faces of said face-up tubes or funnels; and a plurality of posts positioned around the periphery of the container between said base and cap for spacing said base and cap and for giving stacking strength to the container, said container being structured to be stacked post-on-post such that said posts support substantially the entire load of any stacked-on containers.

5. The container defined by claim 4 including a shrink-wrap outer covering primarily for sealing the container contents from moisture and dirt.

6. The container defined by claim 4 wherein said base, shelf and cap are nestable and are formed from a material selected from the group consisting of structural foam, ABS, SMC fiberglass, BMC fiberglass, polypropylene, polyethylene, acrylic reinforced with chopped fiberglass, sprayed chopped fiberglass with gel-coated surface, steel or aluminum.

7. The container defined by claim 5 wherein said container has legs for elevating the container body sufficient for passage of the forks of a fork-lift truck therebeneath such that said container serves as its own skid.

8. The container defined by claim 7 wherein said container is rectangular, said base, shelf and cap are rectangular and said posts are four in number — one beng provided in each corner, said cap, shelf and base having integral corner provisions for receiving and holding said posts, said cap having means at each corner defining a recess for receiving the leg of a stacked-on container.

9. The container defined by claim 4 wherein said base has a plurality of cavities for snugly receiving the necks of said face-up tubes or funnels and said cap has a plurality of cavities for snugly receiving the necks of said face-down tubes or funnels.

10. The container defined by claim 9 wherein said other openings in said shelf for receiving a plurality of face-up tubes or funnels are each surrounded on the bottom side by an integral cone for guiding an inserted tube or funnel into the appropriate neck-receiving cavity in said base.

11. The container defined by claim 9 including insert means configured and sized to fit into the face-receiving cavities in said base and cap and itself defining a different cavity for receiving a tube or funnel of different size or shape.

12. A durable, high-stackable, multi-tiered, hydrophobic, self-skidded shipping/storage container especially for cathode ray tubes, comprising:

a stiff, rectangular, nestable, sheet-like base defining four rectangular cavities configured and sized to snugly receive the faces of four face-down tubes;

a stiff, rectangular, nestable, sheet-like shelf having four openings configured and sized to receive the funnels of said face-down tubes and two openings configured and sized to receive the funnels of two face-up tubes nestled in space-conserving relationship between said face-down tubes, said shelf, when assembled, fitting over and resting upon the funnels of said face-down tubes and supporting the funnels of said face-up tubes;

a stiff, rectangular, nestable, sheet-like cap defining two cavities configured and sized to snugly receive the faces of said two face-up tubes and four cavities configured and sized to snugly receive the necks of said four face-down tubes;

four posts, one at each corner of the container, positioned between said base and cap for spacing said base and cap and for giving stacking strength to the container, said cap, shelf and base having integral corner provisions for receiving and holding said posts, said container being structured to be stacked post-on-post such that said posts support substantially the entire load of any stacked-on containers; and skid obviating means formed integrally in said base and defining a passageway for the forks of a fork-lift truck beneath the container body.

13. The container defined by claim 12 including a shrink-wrap outer covering primarily for sealing the container contents from moisture and dirt.

14. The container defined by claim 12 wherein said base, shelf, cap and posts are formed from a material selected from the group consisting of structural foam, ABS, SMC fiberglass, BMC fiberglass, polypropylene, polyethylene, acrylic reinforced with chopped fiberglass, sprayed chopped fiberglass with gel-coated surface, steel or aluminum.

15. The container defined by claim 14 wherein said base has integral hollow legs which constitute said skid-obviating means and which constitute said provision in said base for receiving and holding said posts.

16. The container defined by claim 15 wherein said base includes two cavities configured and sized to snugly receive the necks of said face-up tubes.

17. A durable, high-stackable, hydrophobic, multi-tiered, self-skidded shipping/storage container especially for cathode ray tube funnels, comprising:

a stiff, rectangular, sheet-like base defining a predetermined number of rectangular cavities configured and sized to snugly receive the faces of a like number of face-down funnels;

a tiered plurality of rectangular, sheet-like shelves each having openings in said predetermined number, said openings each being configured and sized to fit over a face-down funnel, said shelf having near each opening means for preventing a funnel which is placed face-down on said shelf over the protruding neck of an underlying face-down funnel from slipping on said shelf, each shelf, when assembled, fitting over and resting upon underlying face-down funnels and supporting in nested relationship with the underlying funnels the funnels of another set of face-down funnels;

a stiff, rectangular, sheet-like cap defining cavities configured and sized to snugly receive the necks of the top layer of said face-down funnels;

four posts, one at each corner of the container, positioned between said base and cap for spacing said base and cap and for giving stacking strength to the container, said cap, shelf and base having corner provisions for receiving and holding said posts, said container being structured to be stacked post-on-post such that said posts support substantially the entire load of any stacked-on containers; and skid obviating means formed integrally in said base and defining a passageway for the forks of a fork-lift truck beneath the container body.

18. The container defined by claim 17 wherein at least the uppermost one of said shelves has additional openings for receiving face-up funnels nestled in space-conserving relationship between the funnels in the top layer of face-down funnels, and wherein said cap has cavities configured and sized to snugly receive the faces of said face-up funnels.

19. The container defined by claim 17 including a shrink-wrap outer covering primarily for sealing the container contents from moisture and dirt.

20. The container defined by claim 17 wherein said base has integral hollow legs which constitute said skid-obviating means and which constitute said provision in said base for receiving and holding said posts.

* * * * *